US010657936B2

(12) United States Patent
Konishi

(10) Patent No.: US 10,657,936 B2
(45) Date of Patent: May 19, 2020

(54) ELECTRONIC MUSICAL INSTRUMENT, ELECTRONIC MUSICAL INSTRUMENT CONTROL METHOD, AND STORAGE MEDIUM

(71) Applicant: CASIO COMPUTER CO., LTD., Shibuya-ku, Tokyo (JP)

(72) Inventor: Tomomi Konishi, Fuchu (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/367,689

(22) Filed: Mar. 28, 2019

(65) Prior Publication Data

US 2019/0304420 A1 Oct. 3, 2019

(30) Foreign Application Priority Data

Mar. 30, 2018 (JP) ..... 2018-069785

(51) Int. Cl.
*G10H 1/00* (2006.01)
*G10G 3/04* (2006.01)

(52) U.S. Cl.
CPC ..... *G10H 1/0041* (2013.01); *G10G 3/04* (2013.01); *G10H 1/0008* (2013.01)

(58) Field of Classification Search
CPC ..... G10H 1/0041; G10H 1/0008; G10G 3/04
USPC ..... 84/609
See application file for complete search history.

(56) References Cited

U.S. PATENT DOCUMENTS 5,672,837 A * 9/1997 Setoguchi ..... G10H 1/0008 84/609
5,990,406 A 11/1999 Nakamura et al.
6,121,536 A * 9/2000 Malcolm ..... G10H 1/0066 84/645
6,143,973 A * 11/2000 Kikuchi ..... G10H 1/0066 84/600

(Continued)

FOREIGN PATENT DOCUMENTS

JP 10149162 A 6/1998
JP 11175062 A 7/1999
JP 2000194383 A 7/2000

*Primary Examiner* — Jeffrey Donels
(74) *Attorney, Agent, or Firm* — Holtz, Holtz & Volek PC

(57) ABSTRACT

An electronic musical instrument includes a display, a memory, and at least one processor. The memory is configured to store a plurality of song data items. Each of the plurality of song data items includes a plurality of event data items and the plurality of song data items does not include size information of each of the plurality of event data items. The at least one processor is configured to read at least one song data item from among the plurality of song data items, add an identifier to each of the plurality of event data items of the read at least one song data item, calculate size information for each of the plurality of event data items, associate the size information calculated for each of the plurality of event data items with the corresponding identifier, display a content of a first event data item, refer to the associated size information when the content of the first event data item is displayed on the display and a content of a second event data item is not displayed on the display, and display, in accordance with the associated size information referred to, the content of the second event data item on the display, instead of displaying the content of the first event data item.

11 Claims, 8 Drawing Sheets

(56) References Cited

U.S. PATENT DOCUMENTS

2006/0123981 A1* 6/2006 Chang ..... G10H 1/0066
84/645

* cited by examiner

| EVENT SIZE TABLE | |
|---|---|
| EVENT DATA ITEM CONSECUTIVE NUMBER | DATA SIZE |
| 1 | 5byte |
| 2 | 6byte |
| 3 | 8byte |
| 4 | 4byte |
| 5 | 7byte |
| ... | ... |
| i | ... |
| ... | ... |

ELECTRONIC MUSICAL INSTRUMENT, ELECTRONIC MUSICAL INSTRUMENT CONTROL METHOD, AND STORAGE MEDIUM

CROSS-REFERENCE TO RELATED APPLICATION

This application claims the benefit of Japanese Patent Application No. 2018-069785, filed on Mar. 30, 2018, the entire disclosure of which is incorporated by reference herein.

FIELD

The present description relates to an electronic musical instrument, an electronic musical instrument control method, and a storage medium.

BACKGROUND

The musical instrument digital interface (MIDI), which is an international standard, is used for digital transmission of performance data of electronic musical instruments between the instruments.

In Unexamined Japanese Patent Application kokai Publication No. H11-175062, an electronic musical instrument is described that has a function for inserting a meta-event defined as an edit point instruction event with respect to a position set as an edit point in a song data item created using the MIDI standard. An array of event information is formed so as to obtain appropriate performance results when a data interval formed using the edit point as the base point is reproduced. The editing device side is configured to perform distinguishing of the edit point on the basis of the edit point instruction event, linking of data by use of data intervals delineated by the edit point, or the like, and music performance information is edited.

Without limitation to the electronic musical instrument described in Unexamined Japanese Patent Application Kokai Publication No. H11-175062, when editing is performed using an electronic musical instrument, in the case in which the size of the event included in the song data item is a fixed length, forward or backward searching can be performed by repositioning the address by fixed length-size portions. However, in the case in which the data size of the event has a variable length, the size information is embedded in the data item itself, and forward or backward searching can be done by repositioning the address by a size portion indicated by the size information. When the size information is embedded in the song data item itself, although the song data item including the event size of variable length can be treated, the size of the song data item itself increases, and thus adoption of this method is difficult when memory is restricted. Moreover, since the electronic musical instrument described in Unexamined Japanese Patent Application Kokai Publication No. H11-175062 requires the including of data indicating the edit point in the song data item, the adoption of this method is difficult when memory is restricted.

According to an aspect of the present disclosure, an event data item of variable size included in each of a plurality of song data items can be edited while suppressing data size of each of the plurality of song data items.

SUMMARY

An electronic musical instrument according to one aspect of the present disclosure includes a display, a memory, and at least one processor. The memory is configured to store a plurality of song data items. Each of the plurality of song data items includes a plurality of event data items and the plurality of song data items does not include size information of each of the plurality of event data items. The at least one processor is configured to read at least one song data item from among the plurality of song data items, add an identifier to each of the plurality of event data items of the read at least one song data item, calculate size information for each of the plurality of event data items, associate the size information calculated for each of the plurality of event data items with the corresponding identifier, display a content of a first event data item, refer to the associated size information when the content of the first event data item is displayed on the display and a content of a second event data item is not displayed on the display, and display, in accordance with the associated size information referred to, the content of the second event data item on the display, instead of displaying the content of the first event data item.

BRIEF DESCRIPTION OF THE DRAWINGS

A more complete understanding of this application can be obtained when the following detailed description is considered in conjunction with the following drawings, in which.

DETAILED DESCRIPTION

An embodiment of the present description is described below with reference to drawings.

Figure 1:
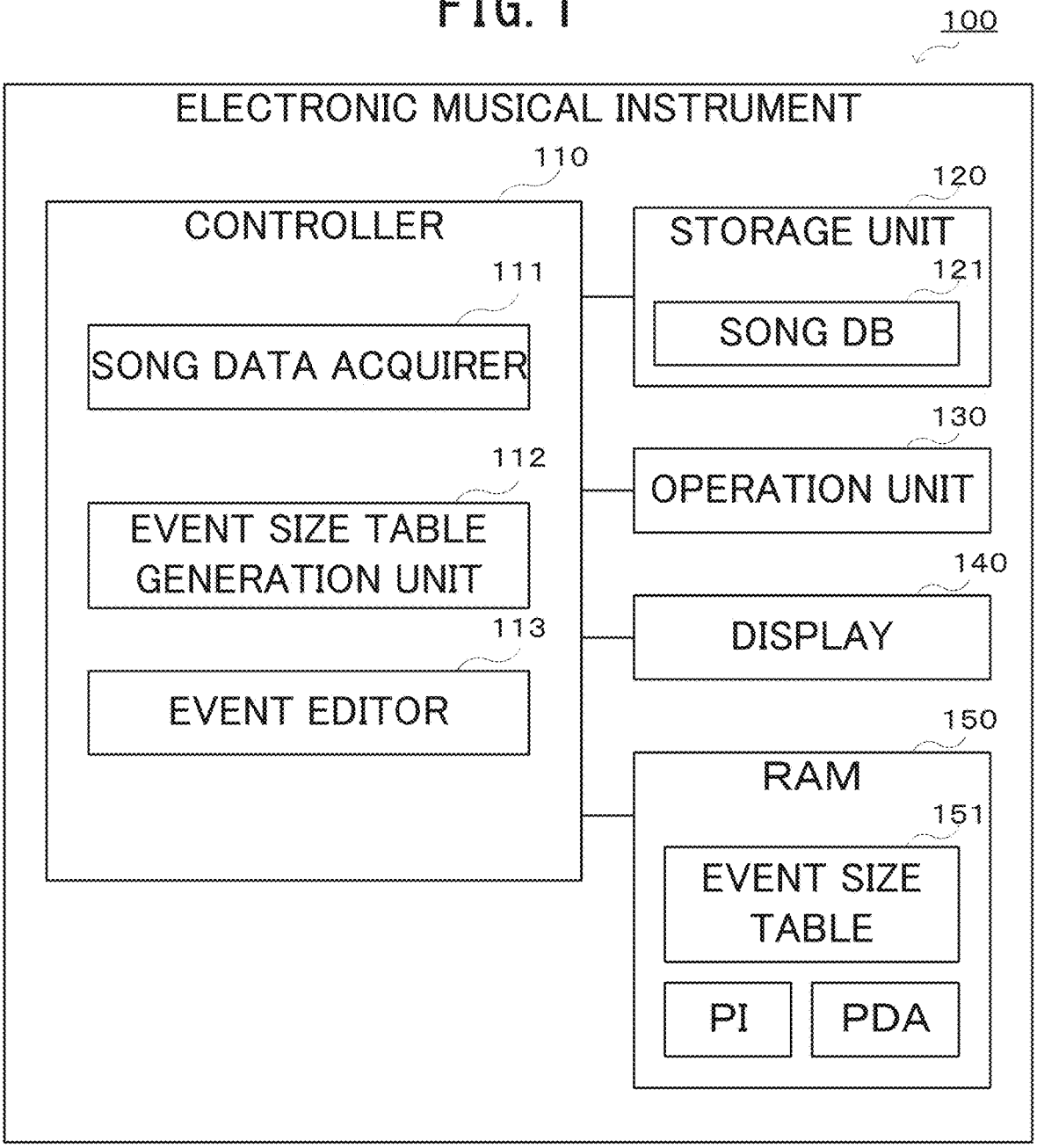
FIG. 1 is a schematic block diagram illustrating an example configuration of an electronic musical instrument according to an embodiment of the present disclosure.

As illustrated in FIG. 1, an electronic musical instrument 100 according to the embodiment of the present disclosure includes a controller 110, a storage unit 120, operational unit 130, a display 140, and a random access memory (RAM) 150.

The controller 110 includes a central processing unit (CPU). In the controller 110, the CPU performs overall control of the electronic musical instrument 100 by reading programs and data contained in the storage unit 120 and using the RAM 150 as a working area.

The storage unit 120 is non-volatile semiconductor memory such as flash memory, erasable programmable ROM (EPROM), or electrically erasable programmable ROM (EEPROM), and assumes the role of a so-called secondary storage device or auxiliary storage device. The storage unit 120 stores programs and data used by the controller 110 for performing various types of processing, and also stores data generated or acquired by the controller 110 performing various types of processing. In the present embodiment, the storage 120 contains a song database (DB) 121 that stores song data items.

Figure 2:
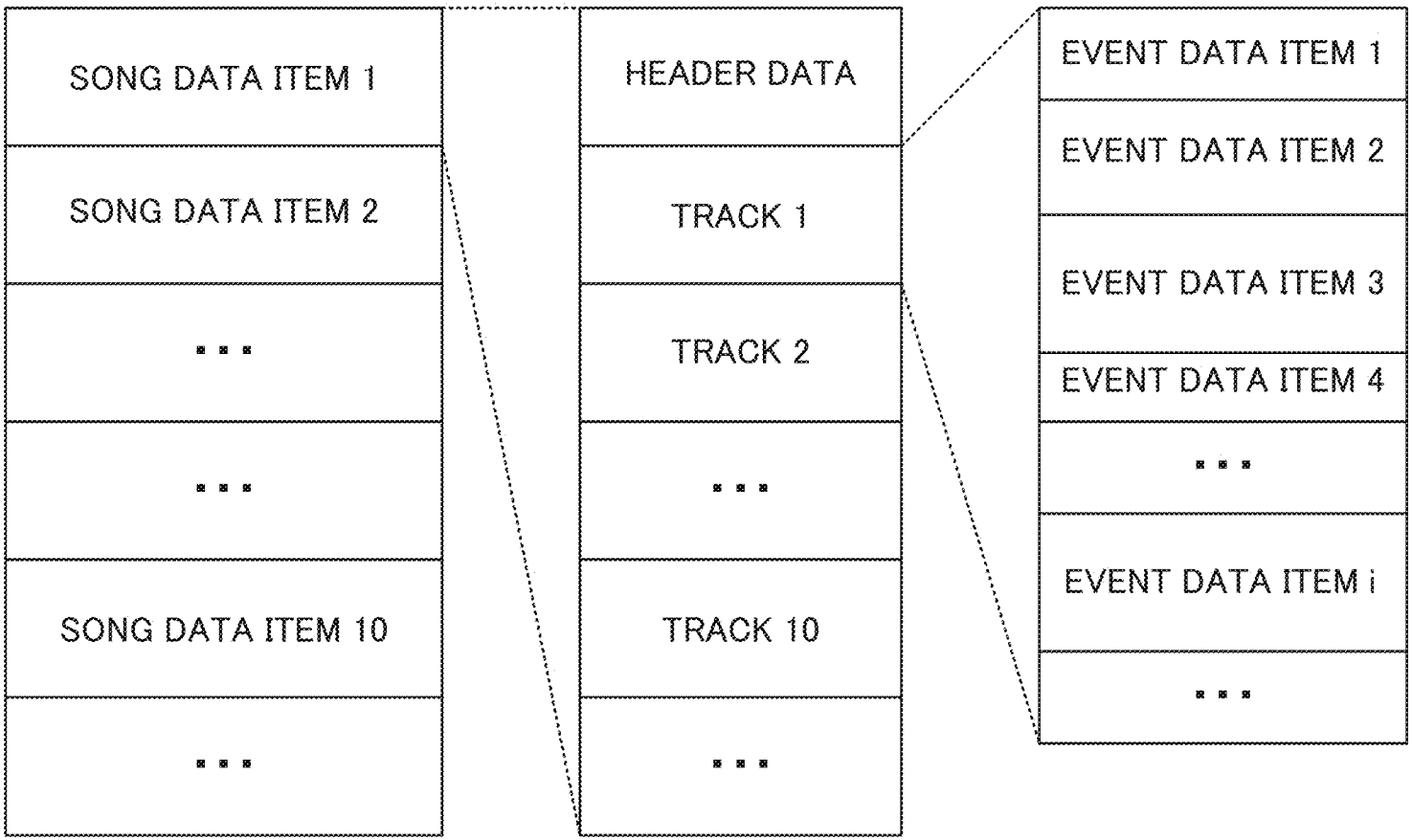
FIG. 2 illustrates an example of data contained in a song database (DB) according to the embodiment of the present disclosure.
Figure 3:
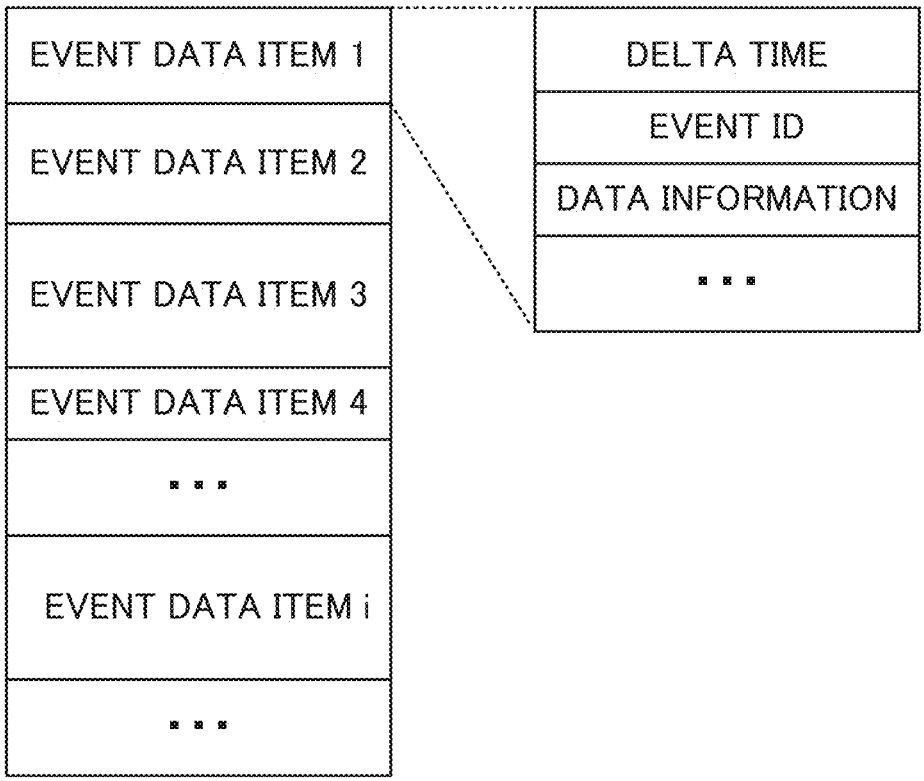
FIG. 3 illustrates an example of data contained in the song DB according to the embodiment of the present disclosure.

As illustrated in FIG. 2, the song DB 121 stores a plurality of song data items. The song data item, for example, includes data indicating a single piece of music. The song data item, for example, has a data configuration standardized on the musical instrument digital interface (MIDI) specification. The song data item includes header data and multiple tracks. The header data includes information such as information on a track count. The track includes a performance track of an instrument, such as a performance track of a piano, a performance track of a guitar, or the like. As illustrated in FIG. 3, the track includes multiple event data items. The event data item includes data such as a note-on, a note-off, timbre data, a pan value, or the like. The note includes data such as pitch, velocity, or the like. The timbre data includes timbre data of instruments such as piano timbre, guitar timbre, or the like. The pan value specifies a sound image localizing position. The event data item includes information that is an ID indicating a type of the event, data of the event, and delta time information. The event data item is data of variable size. Moreover, the event data item does not include data indicating the data size of the event data item itself.

That is to say, the storage unit 120 stores the plurality of song data items. Each of the plurality of song data items includes a plurality of event data items, and the plurality of song data items does not include size information of each of the plurality of event data items.

The operational unit 130 is an input device such as a keyboard, touchpad, buttons, or the like. The operational unit 130 receives an input operation from the user, and outputs to the controller 110 an input signal indicating content of the operation. Moreover, the operational unit 130 may be a keyboard that has multiple white and black keys.

Figures 4, 5:
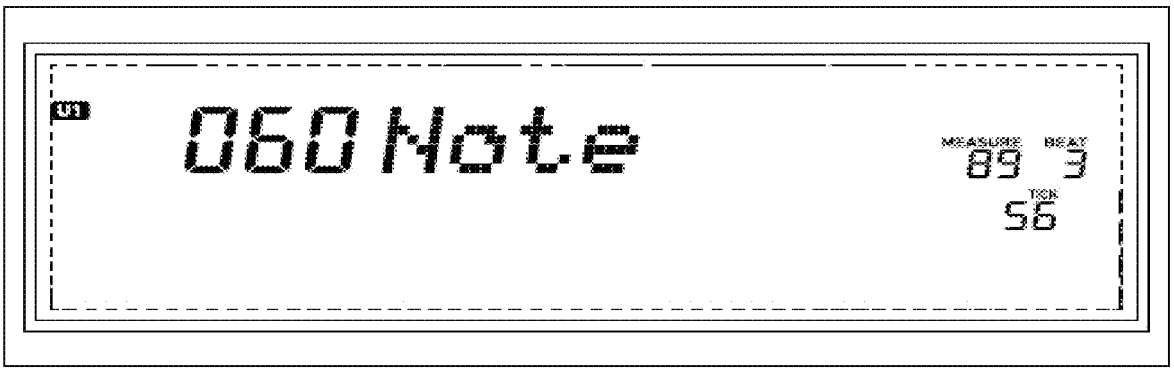
FIG. 4 illustrates an example of a display of the electronic musical instrument according to the embodiment of the present disclosure.
FIG. 5 illustrates an example of data contained in an event size table according to the embodiment of the present disclosure.

The display 140 is equipped with a display controller and a display panel such as a liquid crystal display (LCD) panel, an organic electro-luminescence (EL) panel, a light emitting diode (LED) panel, or the like. Moreover, the display 140 displays an image in accordance with a control signal from the controller 110. In the present embodiment, items such as types of selection target events, parameters values, or the like, for example, are displayed. Furthermore, the operational unit 130 and the display may arranged by superposition on each other as a touch panel or a touch screen. An example of the display 140 is illustrated in FIG. 4. The indication "060 Note" appearing on the display 140 means the pitch of C4. The indications "MEASURE 89", "BEAT 3", and "TICK 56" means that the target event exits at the position of the 89th measure, 3rd beat, and 56th tick, respectively.

That is to say, a content of a first event data item of the plurality of event data items included in a single song is displayed on the display 140, and when the content of the first event data item of the plurality of event data items is not displayed on the display 140, the size information of the first event data item associated in the below-described event size table is referred to, and a content of the second event data item is displayed on the display 140. Moreover, when the display 140 displays the content of the first event data item, the display 140 does not display the content of the second event data item, and when the display 140 displays the content of the second event data item, the display 140 does not display the content of the first event data item. In other words, the display 140 displays a content of one event data item of the plurality of event data items, and does not display contents of two or more event data items of the plurality of event data items simultaneously.

The RAM 150 illustrated in FIG. 1 is a volatile memory, and is used as a working region for executing programs for the controller 110 to perform various types of processing. The RAM 150 stores an event pointer PI from the lead event of the event data item of a read target and a data address pointer PDA indicating a logical address of the lead data of the event data item designated by the event pointer PI. Moreover, as illustrated in FIG. 5, the RAM 150 stores an event size table 151 linking together consecutively numbered event data item and the data sizes of the event data item.

The controller 110 of the electronic musical instrument 100 according to the embodiment is described next. As illustrated in FIG. 1, the controller 110 functions as a song data acquirer 111, an event size table generation unit 112, and an event editor 113, by the CPU reading and executing programs and data contained in the storage unit 120.

The song data acquirer 111 executes song data acquisition processing to acquire the song data item from the song DB 121 of the storage unit 120. For example, the controller 110, via the operational unit 130, acquires the song data item selected by a user from the song data items stored in the song DB 121.

The event size table generation unit 112 generates the event size table 151 that links together the consecutively numbered event data item and the data size (size information) of the event data item within the editing target track selected by the user. As illustrated in FIG. 3, each of the event data item does not include the size thereof. In the state in which the size of the event data item is unclear, a period is required for searching the event, and searching and selection of the event to be edited is difficult. Thus when the track is selected, the event size table generation unit 112 refers to the event size tables 151 associating the event included in the track with the size of the track. Furthermore, consecutive numbers of the event data items function as identifiers enabling distinction between the event data items. Specifically, the event size table generation unit 112 selects the editing target track designated by the user. The event size table generation unit 112 acquires the start address Aa of the event data item included in the editing target track and having the consecutive number i. Thereafter, the event size table generation unit 112 acquires the start address Ab of the event data item having the consecutive number "i+1". The event size table generation unit 112 calculates the different "Ab−Aa" between both addresses, and records the difference "Aa−Ab" in the entry of consecutive number i of the event size table 151 illustrated in FIG. 5.

That is to say, the processor 110 reads at least one song data item from among the plurality of song data items, and add consecutive number information (consecutive numbers) to the plurality of event data items of the read at least one song data item. Specifically, in order to read at least one song data item from among the plurality of song data items, the processor 110 reads each of the plurality of event data items included in the at least one song data item from a location designated by an event pointer PI indicating a reading position in the storage unit 120 and being a location that is changed in accordance with the size information of each of the plurality of event data items.

The size information of each of the plurality of event data items is calculated, and the size information calculated for each of the plurality of event data items is associated with the consecutive number information.

In the present embodiment, such associated data is termed an "event size table". Specifically, in order to calculate the size information of each of the plurality of event data items, a start address of each of the plurality of event data items included in the read at least one song data item is acquired, and the size information of each of the event data items is calculated from each acquired start address.

The event editor 113 performs edit processing, such as correcting, appending, deleting, or the like, of the event data item designated by the event pointer PI. Prerequisites for this edit processing are searching for the target processing event and selecting the target processing event. Thus in order to select the editing target event, the event editor 113 receives an operation performed on the operational unit 130.

For such selection processing, the event editor 113 acquires the consecutive number i of the event data item designated by the event pointer PI and the value of the present data address pointer PDA. Upon receiving the designation through the data address pointer PDA via the operational unit 130, the event editor 113 refers to the event size table 151 and acquires a data size AC of the event data item having the consecutive number i. Next, the event editor 113 adds the data size AC to the value of the data address pointer PDA, advances the logical address of the lead data of the access target event data item, and also increments the value i of the event pointer PI by one.

In contrast, upon receiving via the operational unit 130 an instruction to return to the event pointer PI, the event editor 113 refers to the event size table 151, and acquires a data size AD of the event data item having a consecutive number "i−1". Next, the event editor 113 subtracts the data size AD from the value of the data address pointer PDA, returns to the logical address of the lead data of the access target data, and also decrements the value i of the event pointer PI by one.

Moreover, the event editor 113 inserts into the editing target track the event input by the user via the operational unit 130. Then the event editor 113 acquires the data size of the inserted event, and stores the data size of the inserted event in the event size table 151, the data size being linked to the consecutive number of the insertion position. Next, the event editor 113 moves down the consecutive numbers of the subsequent data items following the event data item of the inserted event. Alternatively, the event editor 113 deletes from the editing target track the event designated by the user via the operational unit 130, and moves up the consecutive numbers of the subsequent data items following the event data item of the deleted event.

The event size table generation processing executed by the electronic musical instrument 100 is described next.

Figure 6:
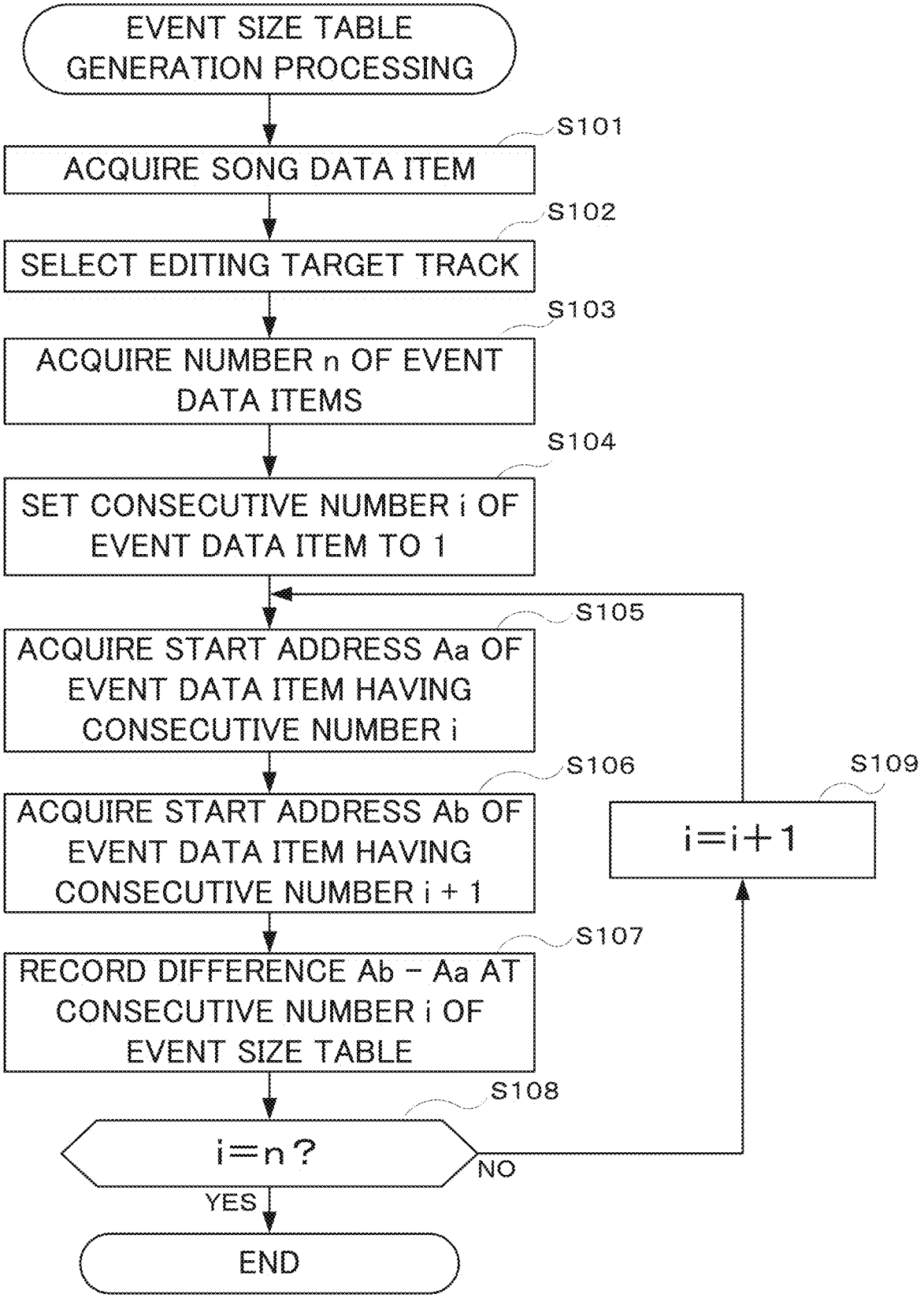
FIG. 6 is a flowchart of event size table generation processing according to the embodiment of the present disclosure.

As illustrated in FIG. 6, upon receiving via the operational unit 130 the operational input indicating the start of the present processing, for example, the controller 110 starts the present processing.

The song data acquirer 111, via the operational unit 130, acquires the song data item selected by the user from the song data items stored in the song DB 121 (step S101).

Next, the event size table generation unit 112 selects the editing target track selected by the user (step S102).

Next, the event size table generation unit 112 acquires the number n of event data items included in the editing target track (step S103).

Next, the event size table generation unit 112 sets the consecutive number i of the event data item to be equal to 1 (step S104).

Next, the event size table generation unit 112 acquires the start address Aa of the event data item having the consecutive number 1 (step S105).

Next, the event size table generation unit 112 acquires the start address Ab of the event data item having the consecutive number 1+1=2 (step S106).

Next, the event size table generation unit 112 calculates Ab−Aa, and records the result of "Ab−Aa" for the consecutive number 1 in the event size table 151 illustrated in FIG. 5 (step S107).

Next, the event size table generation unit 112 determines whether i is equal to n (step S108).

Upon determination that i is not equal to n (NO in step S108), i is incremented (step S109), and processing returns to step S105. Steps S105 to S109 are repeated until i is equal to n. Upon determination that i is equal to n (YES in step S108), the event size table generation processing ends.

Next, event selection processing that is executed by the electronic musical instrument 100 for selection of the editing target event after completion of the event size table generation processing is described.

Figure 7:
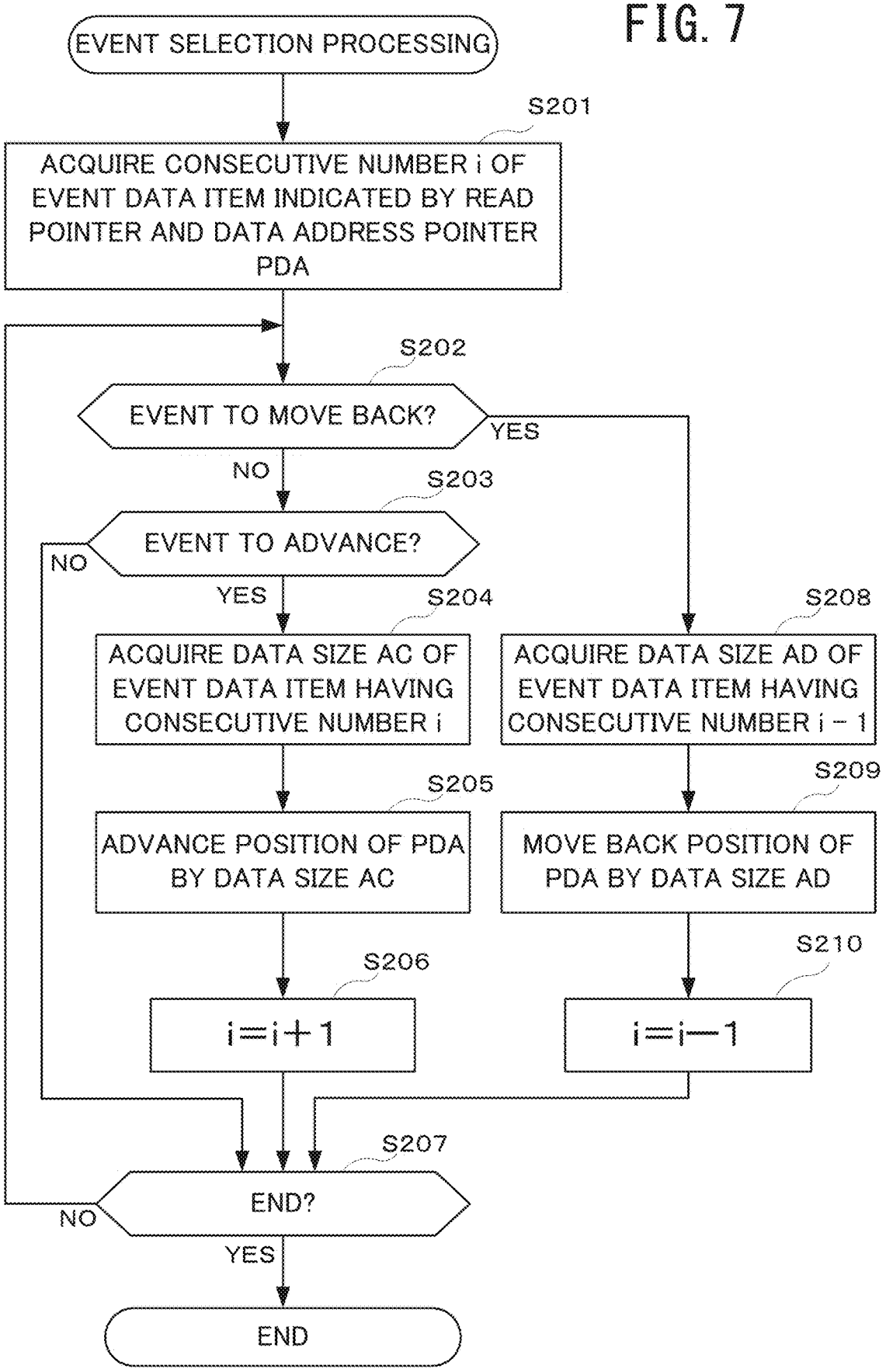
FIG. 7 is a flowchart of event selection processing according to the embodiment of the present disclosure.

Upon receiving via the operational unit 130 the operation input indicating the start of the present processing, for example, the controller 110 starts the event selection processing illustrated in FIG. 7. Furthermore, this input operation is performed in a case in which the user selects an event other than the event indicated by the event pointer PI.

The event editor 113 acquires the consecutive number i of the event data item indicated by the read event pointer PI. Moreover, the value of the data address pointer PDA is acquired (step S201).

Next, the event editor 113 determines whether an instruction is received, via the operational unit 130, to move back the read event pointer PI (step S202).

Upon determination that the instruction is not received to move back the read event pointer PI (NO in step S202), the event editor 113 determines whether an instruction is received, via the operational unit 130, to advance the read event pointer PI (step S203).

Upon determination that the instruction to advance the read event pointer PI (YES in step S203), the event editor 113 refers to the event size table illustrated in FIG. 5, and acquires the data size AC of the event data item having the consecutive number i (step S204).

Next, the event editor 113 advances the data address pointer PDA by the data size AC (step S205). Next, the event editor 113 increments i (step S206).

Next, the event editor 113 determines whether an instruction is received to end the event selection processing (step S207).

Upon determination that the instruction to end the event selection processing is not received (NO in step S207), processing returns to step S202.

Upon determination that the instruction to move back the read event pointer PI is received (YES in step S202), the event editor 113 refers to the event size table 151 illustrated in FIG. 5, and acquires the data size AD of the event data item having the consecutive number i−1 (step S208).

Next, the event editor 113 moves the position of the read address pointer PDA by the data size AD (step S209). Next, the event editor 113 decrements i (step S210).

Next, the event editor 113 determines whether the instruction is received to end the event selection processing (step S207).

Next, upon determination that an instruction is received to end the event selection processing (YES in step S207), the event selection processing ends. After completion of the event selection processing, the event selected by the event selection processing unit is edited on the basis of the instruction inputted via the operational unit 130.

Next, event insertion processing executed by the electronic musical instrument 100 after completion of the event size table generation processing is described.

Figure 8:
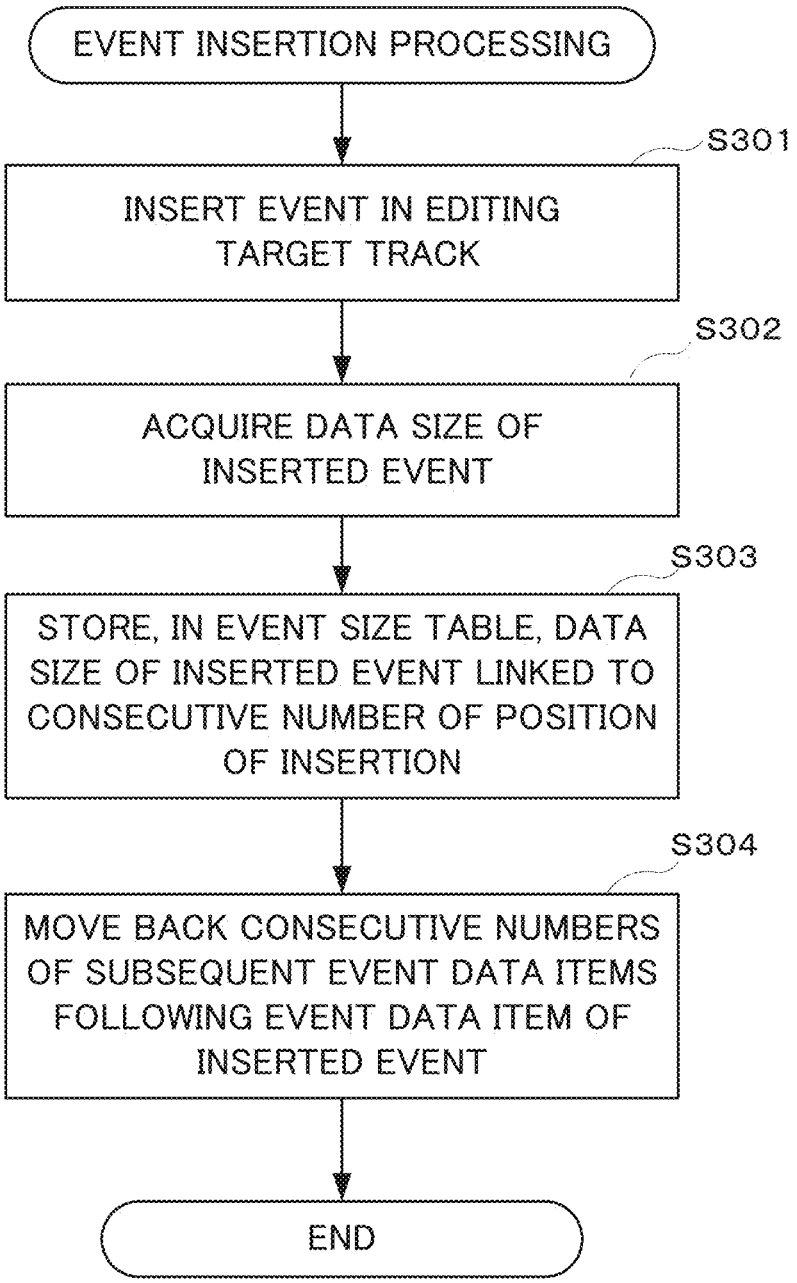
FIG. 8 is a flowchart of event insertion processing according to the embodiment of the present disclosure.

Upon receiving as illustrated in FIG. 8 via the operational unit 130 the operational input indicating the start of the present processing, for example, the controller 110 starts the present processing.

The event editor 113 inserts in the editing target track the event inputted by the user via the operational unit 130 (step S301).

Next, the event editor 113 acquires the data size of the inserted event (step S302).

Next, the event editor 113 stores the data size of the event entered in the event size table 151 linked to the consecutive number of the insertion position (step S303).

Next, the event editor 113 moves down, by the number of the inserted events, the consecutive numbers of the subsequent event data items following the event data item of the inserted event (step S304). Event insertion processing ends thereafter.

Next, event deletion processing executed by the electronic musical instrument 100 having ended the event size table generation processing is described next.

Figure 9:
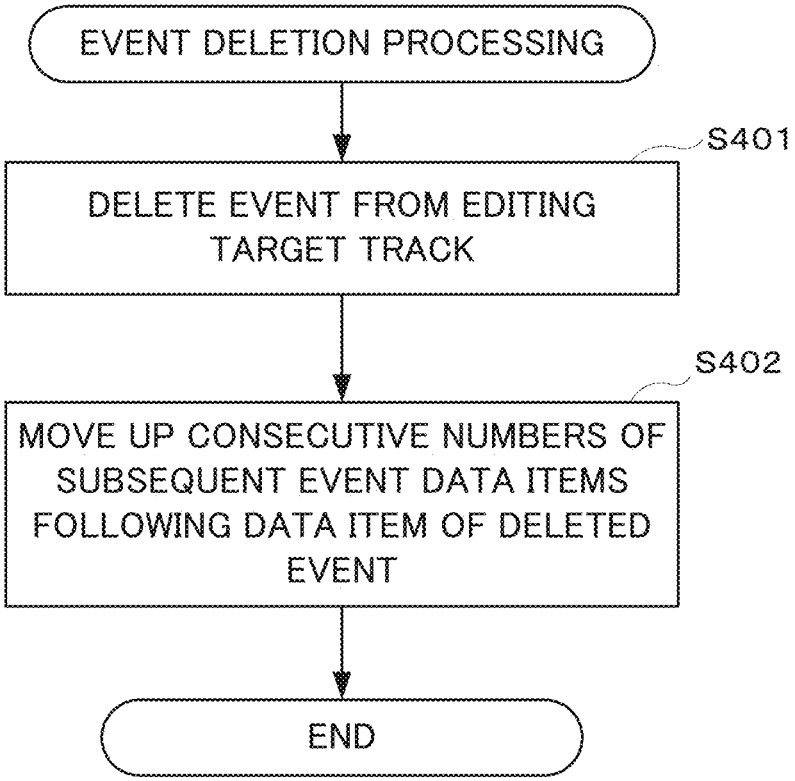
FIG. 9 is a flowchart of event deletion processing according to the embodiment of the present disclosure.

As illustrated in FIG. 9, upon reception via the operational unit 130 of the operational input indicating the start of the present processing, for example, the controller 110 starts the present processing.

The event editor 113 deletes from the editing target track the event designated by the user via the operational unit 130 (step S401).

Next, the event editor 113 moves up the consecutive numbers of the subsequent event data items following the event data item of the deleted event (step S402). Thereafter, the event deletion processing ends.

In the above-described manner, the electronic musical instrument 100 according to the present embodiment does not include size information for each event data item included in the song data items. Thus the event data items included in the song data item can be decreases by a single byte. For example, when the song data item includes 40,000 event data items, the song data item can be decreased by 40 KB relative to the example of related art. If the conventional size of the song data item of a single song is assumed to be 360 KB bytes, than the present disclosure enables a decrease in size to 320 KB. Due to referring to the generated event size table 151 during editing, the size information of each event data item can be obtained. Thus editing of the event data item with advantage is enabled even when the data of each event included in the song data item varies in length.

In contrast, when the size information is included in each event data item included in the song data item, an extra storage capacity of 40 KB per single song is required. A region of RAM deployed in the RAM is used for reproduction of the song data item. Moreover, generally 50 song data items are stored in the electronic musical instrument, and thus the region of flash memory (ROM) is increasingly used as the count of the stored song data items increases.

Furthermore, the present disclosure is not limited to the above embodiments, and various types of modifications are possible.

In the aforementioned embodiment, although an example is described of selection that either moved back or advanced forward the event by one event, jumping by multiple events is possible. For example, in the case of jumping by m events, a data amount may be found by summing the data sizes of the jumped m events, this data amount may be added or subtracted from the value of the data address pointer PDA, and the value of the event pointer PI may be found by adding or subtracting m.

Moreover, an example in the aforementioned embodiment is described in which the event size table generation unit 112 generates the event size table 151 linking together the data sizes of the event data item and the consecutive numbers of the event data item. The event size table 151 may be any table as long as the event data and the data size of the event data are linked together in the table. An identifier that can identify the event data may be added to the event data instead of the consecutive numbers. For example, identification numbers including number information or identification data including character information may be added as the identifier to the event data.

Moreover, although the equipment including the controller 110 is described in the aforementioned embodiment by citing as an example the electronic musical instrument 100, the equipment may be an electronic apparatus such as a portable phone, a personal computer (PC), a personal digital assistant (PDA), or the like.

Moreover, an example in the aforementioned embodiment is described in which the CPU of the controller 110 performs the control operations. However, the control operation are not limited to software control by the CPU. Some or the control operations or the entire control operations may be performed using a hardware configuration such as a dedicated logic circuit.

Moreover, in the aforementioned description, an example is cited in which the storage unit 120 formed from non-volatile memory such as flash memory is used as the computer-readable medium that stores the program for processing of the present disclosure. However, the computer-readable medium is not limited to this example, and a portable recording medium may be uses such as a hard disc drive (HDD), a compact disc read only memory (CD-ROM), a digital versatile disc (DVD), or the like. Moreover, a carrier wave may be used in the present disclosure as the medium for providing the data of the programs according to the present disclosure via a communication line.

Additionally, specific detailed portions of the configuration, control procedures, display examples, or the like indicated in the aforementioned embodiment can be modified appropriately within a scope that does not deviate from the gist of the present disclosure.

Specific embodiments of the present invention were described above, but the present invention is not limited to the above embodiments, and modifications, improvements, and the like within the scope of the aims of the present invention are included in the present invention. It will be apparent to those skilled in the art that various modification and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. An electronic musical instrument comprising:

a display;

a memory configured to store a plurality of song data items, each of the plurality of song data items including a plurality of event data items, the plurality of song data items not including size information of each of the plurality of event data items; and at least one processor configured to:

read at least one song data item from among the plurality of song data items, add an identifier to each of the plurality of event data items of the read at least one song data item, calculate size information for each of the plurality of event data items, associate the size information calculated for each of the plurality of event data items with the corresponding identifier, display a content of a first event data item, refer to the associated size information when the content of the first event data item is displayed on the display and a content of a second event data item is not displayed on the display, and display, in accordance with the associated size information referred to, the content of the second event data item on the display, instead of displaying the content of the first event data item.

2. The electronic musical instrument according to claim 1, wherein when displaying the content of the first event data item, the display does not display the content of the second event data item, and when displaying the content of the second event data item, the display does not display the content of the first event data item.

3. The electronic musical instrument according to claim 1, wherein the display displays a content of only one event data item of the plurality of event data items at one time.

4. The electronic musical instrument according to claim 1, wherein the at least one processor is configured to:

acquire a start address of each of the plurality of event data items included in the read at least one song data item in order to calculate the size information of each of the plurality of event data items, and calculate the size information of each of the plurality of event data items from each acquired start address.

5. The electronic musical instrument according to claim 1, wherein the at least one processor is configured to read each of the plurality of event data items included in the at least one song data item from a location designated by a pointer indicating a reading position in the memory, the location being changed in accordance with the size information of each of the plurality of event data items.

6. The electronic musical instrument according to claim 1, wherein the identifier includes identification numbers that include number information or identification data that includes character information.

7. The electronic musical instrument according to claim 1, wherein the identifier includes consecutive number information.

8. The electronic musical instrument according to claim 1, wherein the at least one processor is configured to:

create an association between a first identifier and the size information of the first event data item corresponding to the first identifier, create an association between a second identifier and the size information of the second event data item corresponding to the second identifier, and when a third event data item of the plurality of event data items is added by a user operation between the first event data item and the second event data item, associate the size information of the added third event data item with the second identifier, and associate the size information of the second event data item with a third identifier.

9. The electronic musical instrument according to claim 1, wherein the at least one processor is configured to:

create an association between a first identifier and the size information of the first event data item corresponding to the first identifier, create an association between a second identifier and the size information of the second event data item corresponding to the second identifier, create an association between a third identifier and the size information of a third event data item corresponding to the third identifier, and when the second event data item is deleted by a user operation, associate the size information of the third event data item with the second identifier.

10. A method for causing an electronic musical instrument including (i) a display, (ii) a memory configured to store a plurality of song data items, each of the plurality of song data items including a plurality of event data items, the plurality of song data items not including size information of each of the plurality of event data items, and (iii) at least one processor, the method comprising performing, by the at least one processor:

reading at least one song data item from among the plurality of song data items, adding an identifier to each of the plurality of event data items of the read at least one song data item, calculating size information for each of the plurality of event data items, associating the size information calculated for each of the plurality of event data items with the corresponding identifier, displaying a content of a first event data item, referring to the associated size information when the content of the first event data item is displayed on the display and a content of a second event data item is not displayed on the display, and displaying, in accordance with the associated size information referred to, the content of the second event data item on the display, instead of displaying the content of the first event data item.

11. A non-transitory computer-readable storage medium storing a program for an electronic musical instrument including (i) a display, (ii) a memory configured to store a plurality of song data items, each of the plurality of song data items including a plurality of event data items, the plurality of song data items not including size information of each of the plurality of event data items, and (iii) at least one processor, the program being executable to cause the at least one processor to execute operations comprising:

reading at least one song data item from among the plurality of song data items, adding an identifier to each of the plurality of event data items of the read at least one song data item, calculating size information for each of the plurality of event data items, associating the size information calculated for each of the plurality of event data items with the corresponding identifier, displaying a content of a first event data item, referring to the associated size information when the content of the first event data item is displayed on the display and a content of a second event data item is not displayed on the display, and displaying, in accordance with the associated size information referred to, the content of the second event data item on the display, instead of displaying the content of the first event data item.

* * * * *